US012372336B2

(12) United States Patent
Gustafsson et al.

(10) Patent No.: US 12,372,336 B2
(45) Date of Patent: Jul. 29, 2025

(54) LINER FOR A SHAPED CHARGE AND METHOD FOR MANUFACTURING A LINER

(71) Applicant: SAAB AB, Linköping (SE)

(72) Inventors: Marcus Gustafsson, Karlskoga (SE); Victor Björkgren, Karlskoga (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 18/555,888

(22) PCT Filed: Apr. 19, 2022

(86) PCT No.: PCT/SE2022/050378
§ 371 (c)(1),
(2) Date: Oct. 18, 2023

(87) PCT Pub. No.: WO2022/225438
PCT Pub. Date: Oct. 27, 2022

(65) Prior Publication Data

US 2024/0210148 A1 Jun. 27, 2024

(30) Foreign Application Priority Data

Apr. 23, 2021 (SE) ..... 2100065-8

(51) Int. Cl.
*F42B 1/032* (2006.01)
*F42B 1/028* (2006.01)
*F42B 1/036* (2006.01)

(52) U.S. Cl.
CPC ..... *F42B 1/032* (2013.01); *F42B 1/028* (2013.01); *F42B 1/036* (2013.01)

(58) Field of Classification Search
CPC .. F42B 1/02; F42B 1/028; F42B 1/032; F42B 1/036; E21B 43/116; E21B 43/117
(Continued)

(56) References Cited

U.S. PATENT DOCUMENTS 4,498,367 A * 2/1985 Skolnick ..... F42B 1/032 102/321.1
4,747,350 A * 5/1988 Szecket ..... F42B 1/032 102/306

(Continued)

FOREIGN PATENT DOCUMENTS

GB 2295664 A 6/1996

OTHER PUBLICATIONS

International Search Report and Written Opinion mailed May 25, 2022 for International Application No. PCT/SE2022/050378, 16 pages.

(Continued)

*Primary Examiner* — James S Bergin
(74) *Attorney, Agent, or Firm* — Sage Patent Group

(57) ABSTRACT

A liner for a shaped charge including an inner layer made of a material having a density below 10.5 g/cm$^3$, and an outer layer made of a material having a density below 2.0 g/cm$^3$, wherein the outer layer is formed directly on the inner layer. In a first state, both the inner layer and the outer layer are compressed towards the symmetry axis (x) of the liner, thereby forming a projectile. In a second state, the inner layer forms a penetration jet of the projectile and the outer layer forms a slug of the projectile. The melting point of the outer layer is above 100° C. The invention also concerns a shaped charge including the liner, a method for manufacturing the liner and a method for detonation of the shaped charge.

16 Claims, 4 Drawing Sheets

(58) Field of Classification Search
USPC ..... 102/306, 307
See application file for complete search history.

(56) References Cited

U.S. PATENT DOCUMENTS

| | | | | |
|---|---|---|---|---|
| 5,119,729 | A * | 6/1992 | Nguyen | B22F 3/15 102/307 |
| 6,021,714 | A | 2/2000 | Grove et al. | |
| 6,393,991 | B1 | 5/2002 | Funston et al. | |
| 7,393,423 | B2 | 7/2008 | Liu | |
| 8,381,652 | B2 * | 2/2013 | Glenn | F42B 1/032 102/306 |
| 8,813,651 | B1 | 8/2014 | Hooke | |
| 2019/0310056 | A1 | 10/2019 | Loehken et al. | |

OTHER PUBLICATIONS

International Preliminary Report on Patentability mailed Mar. 22, 2023 for International Application No. PCT/SE2022/050378, 11 pages.
Extended European Search Report mailed Feb. 18, 2025 for European Patent Application No. 22792104.6, 7 pages.

* cited by examiner

LINER FOR A SHAPED CHARGE AND METHOD FOR MANUFACTURING A LINER

CROSS-REFERENCE TO RELATED APPLICATIONS

This application is a 35 U.S.C § 371 national stage application for International Application No. PCT/SE2022/050378, entitled "LINER FOR A SHAPED CHARGE AND METHOD FOR MANUFACTURING A LINER", filed on Apr. 19, 2022, which claims priority to Swedish Patent Application No. 2100065-8, filed on Apr. 23, 2021, the disclosures and contents of which are hereby incorporated by reference in their entireties.

TECHNICAL FIELD

The present disclosure relates to a liner for a shaped charge, a shaped charge comprising the liner, a method for manufacturing the liner and a method for detonation of the shaped charge comprising the liner.

BACKGROUND ART

Shaped charges are widely used for penetrating hard targets such as armour and for providing perforations in wells in oil and gas industry.

A shaped charge comprises a casing and an explosive charge arranged within the casing. The explosive charge is typically hollow forming a cavity which is lined with a thin metal liner from which a penetration jet is formed upon detonation of the explosive charge. The jet formation process is started by initiation of the explosive charge with a detonator unit. The detonation front travels in an expanding spherical shock wave. As the shock wave passes through the metal liner, the liner collapses. This causes formation of the penetration jet having a relatively small mass of metal moving at an extremely high velocity and a relatively large mass of metal known as a slug following the penetration jet at a much lower velocity. The higher velocity of the penetration jet, the deeper penetration depth is obtained.

It is well-known that heavy metals, such as tungsten, uranium gold or alloys of such metals are effective for penetration purposes. However, drawbacks of heavy metals are that they have poor mechanical properties, add weight to the shaped charge and are expensive.

Therefore, bi-metal liners comprising an inner layer of a heavy metal and an outer layer of another metal such as copper or aluminium have been proposed. There are also examples of liners comprising plastics material, which typically are used for providing wide penetration holes rather than deep penetration holes.

Although various attempts to improve the properties of liners have been made, for example by varying the shape, size and/or material(s) of the liner, there is still a large interest to further improve the properties of the liners.

There is need for an improved liner for providing a high velocity of the penetration jet and an effective penetration into the target. There is also need for a liner providing a shaped charge of low overall weight and which is cost efficient to manufacture.

SUMMARY OF THE INVENTION

An object of the present disclosure is to provide a solution for a liner wherein some of the above-identified problems are mitigated or at least alleviated.

The present disclosure proposes a liner for a shaped charge comprising an inner layer made of a material having a density below 10.5 g/cm$^3$, and an outer layer made of a material having a density below 2.0 g/cm$^3$. The outer layer is formed directly on the inner layer. In a first state both the inner layer and the outer layer are compressed towards the symmetry axis of the liner, thereby forming a projectile, and in a second state the inner layer forms a penetration jet of the projectile and the outer layer forms a slug of the projectile.

By a liner comprising an outer layer comprising an inner layer made of a material having a density below 10.5 g/cm$^3$, and an outer layer made of a material having a density below 2.0 g/cm$^3$ the total weight of the liner becomes relatively low. A low total weight of the liner enhances the acceleration of the penetration jet, and thus the velocity of the penetration jet becomes high.

A high velocity of the penetration jet provides for an effective penetration of a target.

A low weight of the liner provides for a weight of a shaped charge comprising the liner which is advantageously e.g. upon transportation of the shaped charge.

The proposed liner provides for a cost efficient way of providing a high velocity of the penetration jet and effective penetration properties as compared to attempts to increase the penetration depth by other types of multi-layer liners comprising expensive metals such as heavy metals or alloys thereof.

Although there may be an increased cost due to the manufacturing step of bonding the outer layer and inner layer together as compared to manufacturing of a single layer liner, the proposed liner provides for a more cost efficient manufacturing process due to lower material costs as compared liners comprising expensive metals such as heavy metals or alloys thereof.

According to some aspects, the outer layer has a density below 1.7 g/cm$^3$, preferably below 1.4 g/cm$^3$.

As discussed above, a low density of the outer layer provides for a low total weight of the outer layer and thus for a low total weight of the liner. A low total weight of the liner provides for an improved acceleration of the penetration jet and thereby for a penetration jet having a high velocity. A high velocity of the penetration jet provides for effective penetration properties.

According to some aspects, the inner layer has a density below 10.3 g/cm$^3$, preferably below 10.1 g/cm$^3$.

The proposed density provides for the desired effective penetration properties. At the same time, the proposed density of the inner layer provides for a low total weight of the liner, and thus for a low weight of a shaped charge comprising the liner.

According to some aspects, the melting point of the outer layer is above 100° C., preferably above 200° ° C., most preferably above 300° C.

The proposed melting points of the outer layer provides for resistance towards high temperatures and high pressures upon detonation a time long enough such that the projectile is formed. Thus, the outer layer contributes to formation of the projectile.

According to some aspects, the outer layer is a plastics material such as a thermoplastic polymer or a thermosetting polymer.

An advantage of a plastics material is that it has a low density which provides for a low weight of the liner and thus for a low total weight of a shaped charge in which the liner is comprised. A plastics material is also relatively cheap, thereby providing for a cost efficient liner and thus a cost efficient shaped charge. In addition, thermoplastic polymers and thermosetting polymers have a relatively high melting point and are thereby heat resistant.

According to some aspects, the thermoplastic material is polytetrafluorethene, PTFE, or polyetheretherketone, PEEK.

Polytetrafluorethene, PTFE, and polyetheretherketone, PEEK are examples of plastics materials having low densities, high melting points as well as low cost.

According to some aspects, the thermosetting polymer is polyurethanes or epoxy.

Polyurethanes and epoxy are examples of plastics materials having low densities, high melting points as well as low cost.

According to some aspects, the inner layer has a speed of sound of above 3000 m/s, preferably above 3450 m/s, most preferably above 3900 m/s.

A high speed of sound of the inner layer provides for that the velocity of the tip of the penetration jet becomes high without the tip being incoherent. Thus, a high speed of sound of the inner layer provides for effective penetration properties.

According to some aspects, the inner layer comprises a metal such as copper, molybdenum or nickel or an alloy thereof.

An inner layer of metal provides for effective penetration properties.

Copper, molybdenum or nickel or an alloy thereof are advantageously since they have a density which is high enough for providing an effective penetration into a target. At the same time, the density is relatively low as compared to heavy metals which are typically used for providing good penetration properties. Other advantages of copper, molybdenum and nickel or an alloy thereof are their relatively high speed of sound and relatively high plasticity (i.e. the formed penetration jets may be stretched significantly without breaking). These metals are also less expensive as compared to heavy metals.

According to some aspects, the liner is shaped as a cone, frusto-cone, funnel, tulip or trumpet.

The proposed shapes of the liner provides for deep penetration into the target.

According to some aspects, the thickness of the inner layer ranges from 0.2 to 0.8 mm, preferably from 0.3 to 0.7 mm, most preferably from 0.4 to 0.6 mm.

According to some aspects, the thickness of the outer layer ranges from 0.5 mm to 5 mm, preferably from 0.7 to 3 mm, most preferably from 0.9 to 2 mm.

The present disclosure also proposes a shaped charge comprising a liner.

The shaped charge comprises the liner of the present disclosure and have all the associated effects and advantages of the disclosed liner.

The present disclosure also proposes a method of manufacturing a liner for a shaped charge. The method comprises the steps of pressing a plate of the inner layer into a desired shape and molding or curing the outer layer onto the pressed plate of the inner layer.

The method provides a liner which have all the associated effects and advantages of the liner above.

The present disclosure also proposes a method for detonation of a shaped charge comprising a liner. The method comprises the step of detonating an explosive arranged in the shaped charge, wherein a detonation front travels in an expanding spherical shock wave towards the liner. The method further comprises the step of collapsing of the liner. In a first state both the inner layer and the outer layer are compressed towards the symmetry axis of the liner, thereby forming a projectile. In a second state, the inner layer forms a penetration jet of the projectile and the outer layer forms a slug of the projectile.

The method corresponds to the actions performed by the liner as discussed above and have all the associated effects and advantages of the disclosed liner.

DETAILED DESCRIPTION

Figure 1:
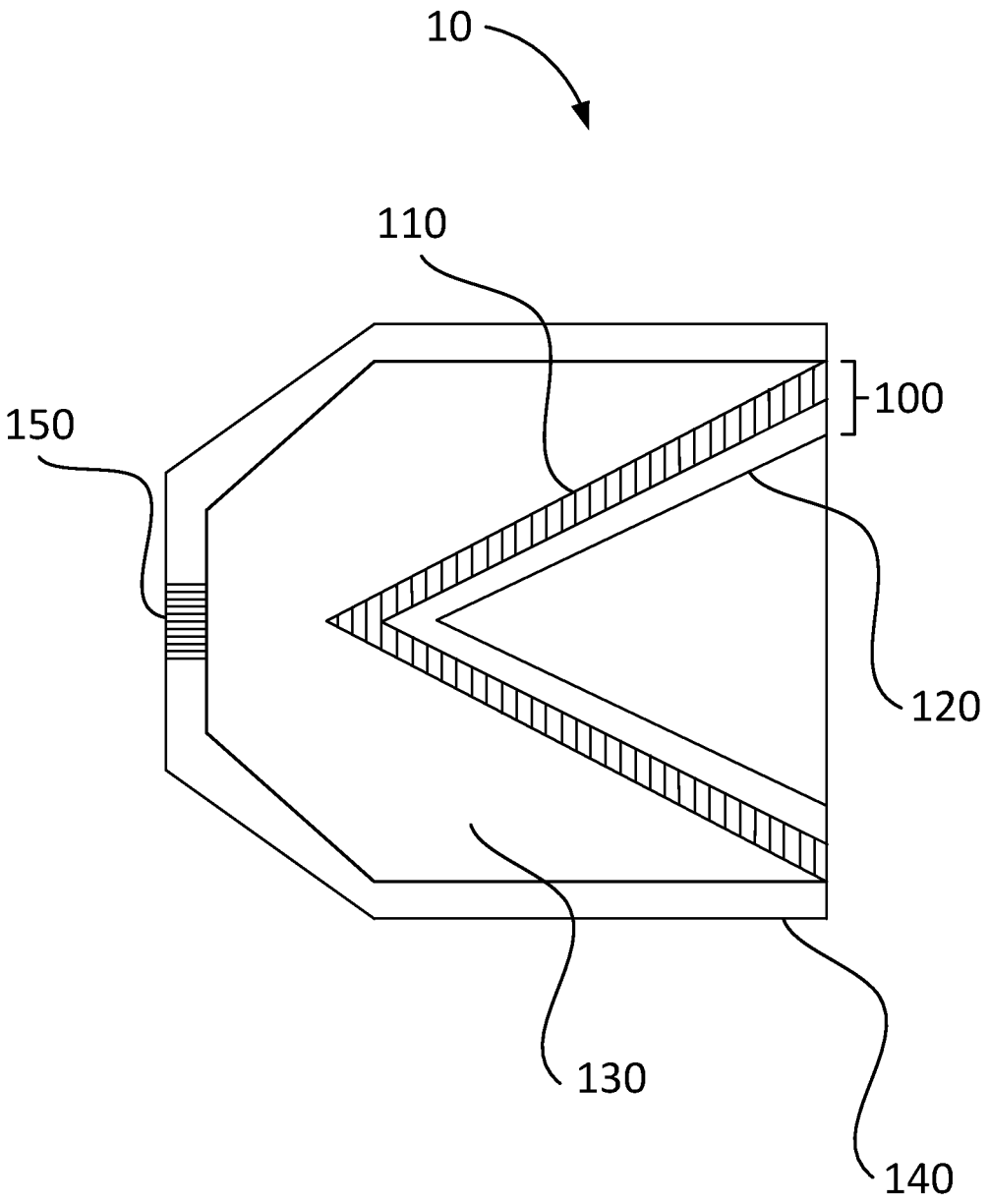
FIG. 1 schematically illustrates a shaped charge comprising a liner according to an example of the present disclosure.

FIG. 1 schematically illustrates a shaped charge 10 comprising a liner 100 according to the present disclosure. The shaped charge 10 comprises a casing 140 and an explosive charge 130 arranged within the casing. The explosive charge 130 may typically be hollow forming a cavity which is lined with the liner 100. The liner 100 comprises an inner layer 120 and an outer layer 110. The shaped charge further comprises a detonator unit 150 which is arranged for initiation of the explosive charge 130 upon detonation of the shaped charge.

A shaped charge is an explosive charge shaped to focus the effect of the energy of the explosive charge. A shaped charge has both military and civil applications. Examples of military applications are in missiles, torpedoes and various other types of weapons. Examples of civil applications are charges used for explosive demolition of buildings and structures as well as for providing perforations in wells in oil and gas industry. The shaped charge may be arranged along the central axis within a warhead, such as a missile or torpedo. In one example, a plurality of shaped charges may be arranged along the central axis within the warhead. The function of the shaped charge upon detonation will be described more in detail with reference to FIG. 3*a* and FIG. 3*b* below.

Figure 2:
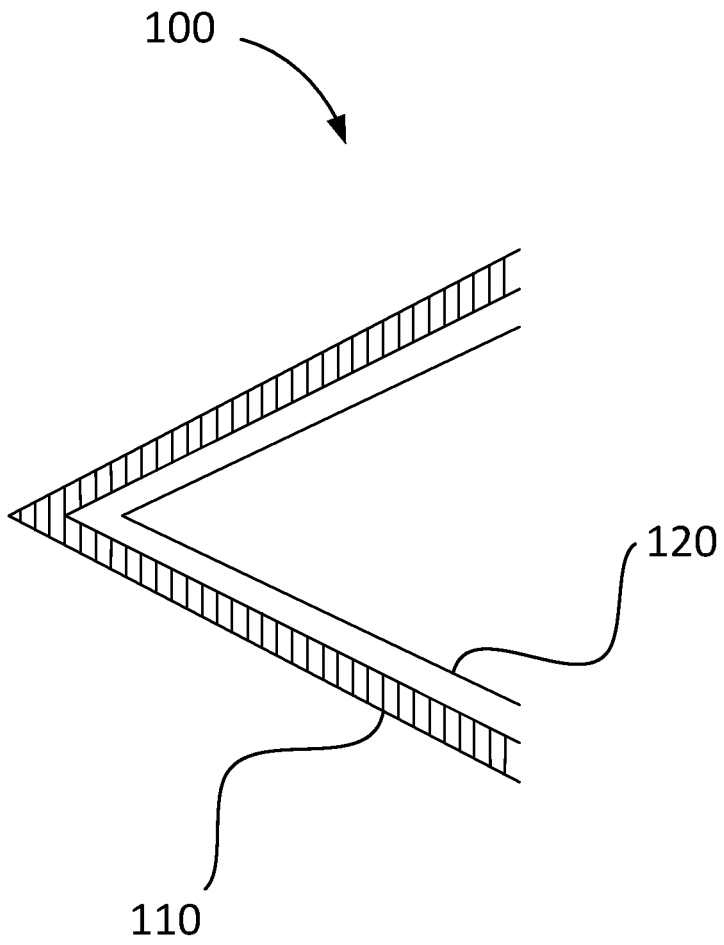
FIG. 2 schematically illustrates a liner according to an example of the present disclosure.

FIG. 2 schematically illustrates a liner 100 for a shaped charge according to the present disclosure. The liner 100 comprises an inner layer 120 and an outer layer 110, wherein the outer layer 110 is formed directly on the inner layer 120. The liner 100 shown in FIG. 2 is shaped as a cone. However, the liner 100 may have other shapes, such as being shaped as a frusto-cone, funnel, tulip, trumpet or half sphere. The shape of the liner is a design parameter which and may be selected depending on the desired properties of liner and thus the desired properties of the shaped charge. Typically, a conical or trumpet shaped liner provides for a deep and narrow penetration of a target as compared to a non-conical liner which provides for a more shallow penetration of the target. A half-spherical shaped liner typically provides for a wider hole in armour and especially in walls. A tulip shaped liner may be utilized for providing either deep penetration or shallow penetration depending on the internal depth of the liner itself. Thus, the most interesting shapes of the liner for providing a deep penetration are conical, trumpet or tulip.

Figure 3A:
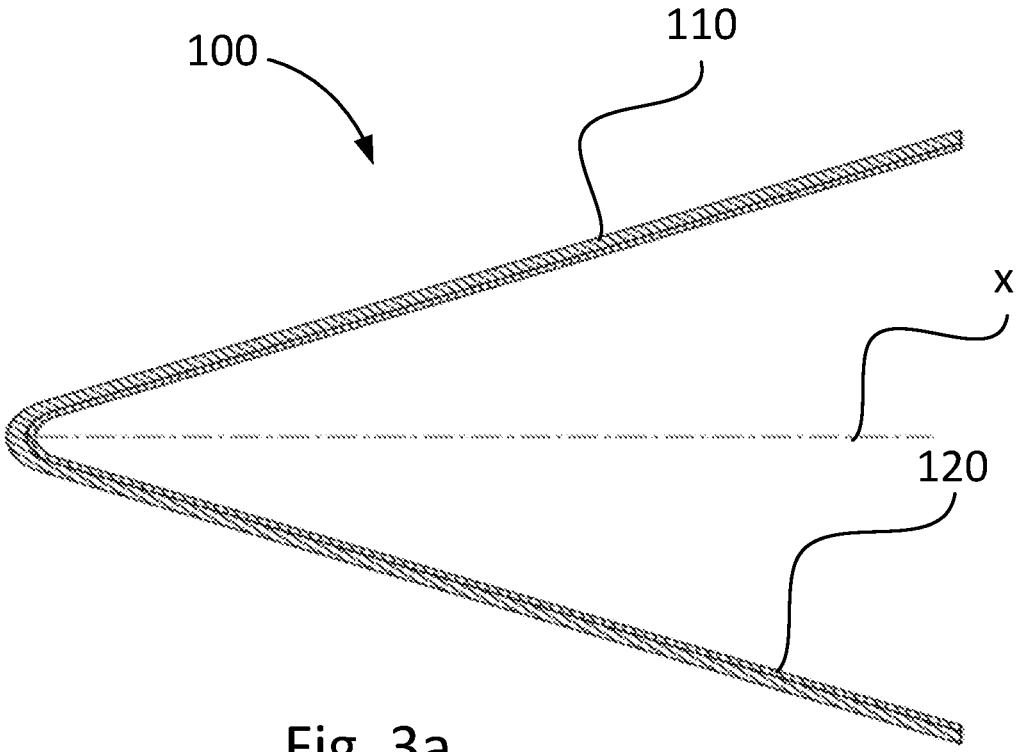
FIG. 3*a* and FIG. 3*b* schematically illustrate a liner according to an example of the present disclosure prior to detonation of an explosive charge and during formation of a projectile, respectively.

FIG. 3*a* schematically illustrates a liner 100 according to an example of the present disclosure prior to detonation of the explosive charge. The liner 100 shown in FIG. 3*a* is conical and comprises an inner layer 120 and an outer layer 110 as described above.

Figure 3B:
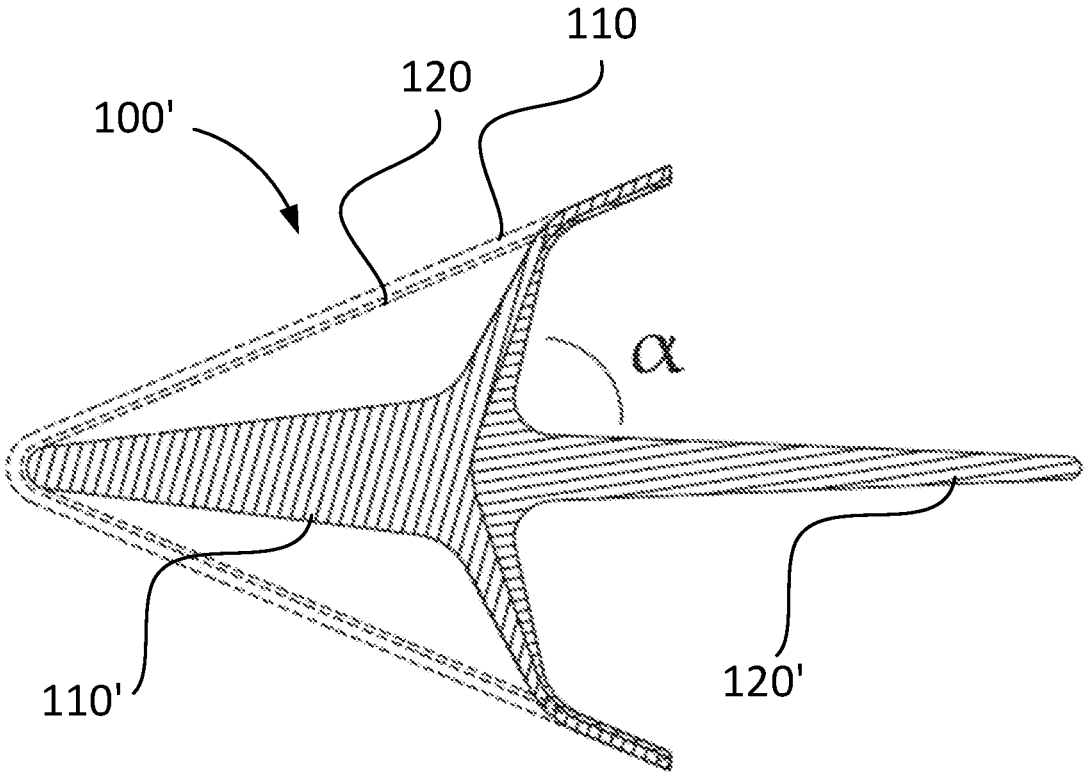

FIG. 3*b* schematically illustrates the liner 100' upon formation of a projectile, wherein the projectile comprises a penetration jet and a slug. The dashed portions in FIG. 3*b* represent the inner layer 120 and the outer layer 110 of the liner prior to detonation of the shaped charge. Upon detonation of the explosive charge, the detonation front travels in an expanding spherical shock wave. As the shock wave passes through the liner 100, the liner collapses. Upon collapse, the liner 100' is compressed towards the symmetry axis x of the liner in a first state, thereby forming a penetration jet 120' and a slug 110' of the collapsed liner. The detonation front is arranged to reach the cone apex first followed by the cone base of the conical liner upon collapse of the liner. As the liner material collapses towards the symmetry axis x, some of the material is accelerated in the direction towards the cone base. The material travelling in this direction forms a penetration jet which stretches out due to a velocity gradient along the symmetry axis x. The penetration jet has an extremely high velocity, wherein the tip of the penetration jet travels at about 7 to 14 km/seconds and the tail of the penetration jet travels at about 1 to 3 km/seconds. This penetration jet is efficient for e.g. penetrating thick plates of armour. The higher velocity of the penetration jet, the deeper penetration depth is obtained. Both the inner layer 120 and outer layer 110 are arranged to contribute to the formation of the projectile.

As discussed above, the inner layer forms a penetration jet 120' of the projectile and the outer layer forms a slug 110' of the projectile. Thus, typically the slug does not comprise portions of the inner layer of the liner. The slug travels in the same direction as the penetration jet, but at a much lower velocity of about less than 1 km/seconds. The velocity of the slug is typically too low to contribute significantly to the penetration. The amount of liner material ending up in the penetration jet and in the slug is determined by the collapse angle $\alpha$ with respect to the symmetry line x.

The high velocity of the penetrating jet of the liner according to the present disclosure as compared to previously known bimetallic liners is obtained since the total weight of the liner become lower. This is due to the fact that an object of a low mass obtains a higher velocity as compared to an object of a higher mass when being exposed to the same force. One drawback may however be that some of the outer layer material of low density, which may not be very good for penetrating properties may remain in the projectile. However, since the low-density material is mainly located in the slug, i.e. in the rear portion of the projectile, it does not, due to the relatively low velocity of the slug, contribute to the penetration anyway and does hence not affect the penetration properties significantly. Thus, the high penetration properties of the high-density material, i.e. the inner layer, is effectively utilized.

The idea of the liner in the present disclosure is to provide a liner with an outer layer having a low density in order to obtain a high velocity of the penetration jet and thereby obtaining a liner which provides a deep penetration depth.

The inner layer may be made of a material having a relatively high density. A high density provides for a high penetration depth. However, the high density may decrease the velocity of the penetration jet. At the same time, the inner layer may be made of a material which is ductile and which does not add a significant weight to the liner and to the shaped charge. The inner layer is made of a material having a density below 10.5 g/cm$^3$.

The inner layer may have a relatively high speed of sound. Preferably, the inner layer has a speed of sound of above 3000 m/s, preferably above 3450 m/s, most preferably above 3900 m/s. By a high speed of sound, the velocity of the tip of the penetration jet becomes high without the tip being incoherent. If the tip becomes incoherent, it "bounces" against the symmetry line of the liner 100 upon detonation and the tip becomes shaped as a tongue of a snake which adversely affecting the penetration properties of the penetration jet.

Further, the inner layer may have a relatively high plasticity or plastic deformation such to provide the penetration jet with an ability to stretch out as much as possible without the jet be divided into fragments in the longitudinal direction. The speed of sound as well as the plasticity of the material may be affected by the manufacturing method of the liner. The plastic deformation of the inner layer may be affected by the grain size of the material, and it is advantageous with a grain size which is as small as possible. The grain size of the material of the inner layer may typically be below 25 μm, preferably, the grain size may be around 15 μm. The grain size is typically the same throughout the material and does not vary within the liner. The grain size is dependent on the manufacturing method of the liner.

In one example, the inner layer may be made of copper or an alloy thereof. Copper has a relatively high density of about 8.926 g/cm$^3$, a relatively high speed of sound of about 4000 m/s (about 3950 m/s for copper without any contaminations) and a relatively high plasticity (i.e. it may be stretched significantly without breaking) as compared to heavy metals which typically is used as the inner layer of a bi-material liner. Alternatively, the inner layer may be made of molybdenum or nickel or an alloy thereof.

The outer layer is formed directly on the inner layer, i.e. there are no additional layers or any hollow space between the inner layer and the outer layer.

The outer layer made of a material having a density below 2.0 g/cm$^3$. Preferably, the outer layer has a density below 1.7 g/cm$^3$, more preferably below 1.4 g/cm$^3$.

As described above, in the first state both the inner layer and the outer layer are compressed towards the symmetry axis of the liner, thereby forming a projectile, and in a second state the inner layer forms a penetration jet of the projectile and the outer layer forms a slug of the projectile. Thus, both the inner layer 120 and outer layer 110 are arranged to contribute to the formation of the projectile (i.e. the penetration jet and the slug). Thus, the inner layer and outer layer have to be resistant towards high temperatures (about 500° C.) and high pressures (about 100 GPa) upon detonation a time long enough such that the projectile is formed. Upon the moment of detonation, the pressure is about 30 GPa, whereas upon collapse of the liner (i.e. when the projectile is formed), a pressure of about 100 GPa is reached. As discussed above, the inner layer is made of a metal, and metals are generally inherently resistant towards high temperatures and pressures. However, the outer layer may typically be made of a less resistant material, such as plastics. Thus, the outer layer has to be chosen to be resistant towards high temperatures and high pressures in order to not decompose upon formation of the projectile, i.e. upon the detonation of the shaped charge. In practice, this means that the outer layer should survive long enough, about a few microseconds under these high pressure and temperature conditions, to be able to collapse. After the formation of the projectile, the material of the outer layer may remain intact and contribute to the projectile, contribute to the slug, or it may decompose.

In order to be resistant towards high temperatures upon detonation, the outer layer may have a relatively high melting point $T_m$ such that it does not decompose upon formation of the projectile. In addition, the outer layer may have a relatively high melting point such that the explosive can be cast directly onto the outer layer upon the manufacturing process. The melting point of the outer layer may be above 100° C., preferably above 200° C., most preferably above 300° C.

The bulk modulus of the outer layer 110 should be relatively high. A low bulk modulus would cause the volume of the outer layer to change drastically upon detonation. In practice, a low bulk modulus would due to compression of the outer layer cause the need for more outer layer material of the liner, e.g. a thicker outer layer. It is possible to add material to the outer layer, however, the size of the liner as well as the total weight of the liner would become increased which is not desirable.

The outer layer 120 may be a plastics layer such as a thermoplastic polymer or a thermosetting polymer. Examples of thermoplastic polymers are polytetrafluorethene, PTFE, also known as Teflon® or polyetheretherketone, PEEK. Polytetrafluorethene, PTFE has a melting point of about 327° C. and polyetheretherketone, PEEK has a melting point of about 343° C. and are thereby relatively heat resistant.

Examples of thermosetting polymers are polyurethanes or epoxy.

The thickness of the inner layer may range from 0.2 to 0.8 mm, preferably from 0.3 to 0.7 mm, most preferably from 0.4 to 0.6 mm. The thickness of the inner layer is dependent on the design of the shaped charge such as the shape of the casing and the explosive. Typically, the thickness of the inner layer may be about 15 to 40% of the total thickness of the liner. In one example, the liner may comprise of about 70% material of the outer layer and about 30% material of the inner layer.

The thickness of the outer layer may range from 0.5 to 5 mm, preferably from 0.7 to 3 mm, most preferably from 0.9 to 2 mm.

In one example, the thickness of the inner and/or outer layer is constant along the longitudinal direction of the liner. Alternatively, the thickness of the inner and/or of the outer layer may vary along the longitudinal direction of the liner. Typically, the liner is rotationally symmetrical about the symmetry axis of the liner.

Typically, the liner may have a total thickness of about 1.0-2.5 mm. The relation between the amount of the inner and the outer material has to be chosen such that the explosive charge is able to accelerate the material of the liner to a desired high velocity. It is desired to obtain a penetration jet comprising almost exclusively the high-density material and a slug comprising the low-density material.

Figure 4:
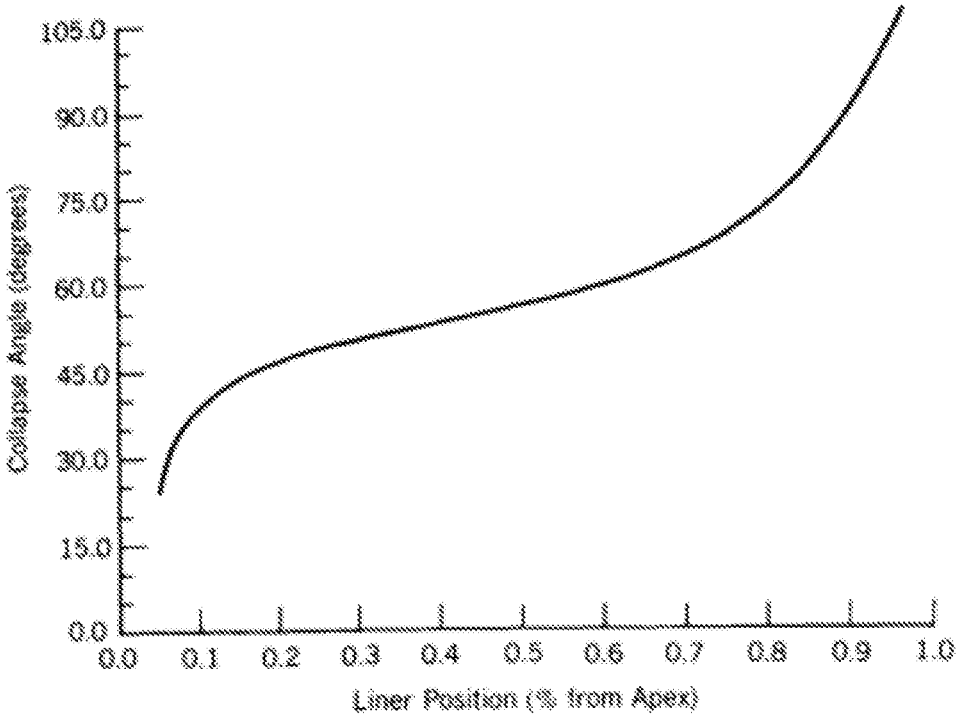
FIG. 4 illustrates the collapse angle as a function of the position of a liner having a cone angle of 42°.

FIG. 4 illustrates an example of the collapse angle as a function of the position of a liner having a cone angle of 42°. As illustrated in FIG. 4, the collapse angle varies quite a lot, depending on the liner position with respect to the apex. The reason for that the collapse angle varies is that adjacent portions of the liner obtain different velocities upon detonation, thereby entering the collapse point different in time. The collapse angle may be chosen to be equal to the cone angle of the liner, but due to that the shock wave has a direction and that there is different amounts of explosive at different positions of the liner, the liner will be "thrown out" a bit obliquely upon detonation. The collapse angle is also affected by other parameters such as thickness of the casing, thickness of the liner etc. By knowledge of the collapse angle, the ratio between the thicknesses of the outer layer and the inner layer, respectively, may be adjusted.

The liner may be manufactured by a method comprising the steps of pressing a plate of the inner layer into a desired shape and casting the outer layer onto the pressed plate of the inner layer. Alternatively, the outer layer and the inner layer may be manufactured by cold flow pressing. In yet an alternative, the liner may be manufactured by 3D printing. In the case of 3D printing, both the inner layer and outer layer of the liner may be manufactured by 3D printing. Alternatively, only one of the inner layer and the outer layer is manufactured by 3D printing.

The invention claimed is:

1. A liner, the liner being shaped as a cone, frusto-cone, funnel or trumpet, for a shaped charge comprising an inner layer made of a material having a density below 10.5 g/cm3, and an outer layer made of a material having a density below 2.0 g/cm3, wherein the outer layer is formed directly on the inner layer and wherein in a first state, upon detonation of the shaped charge and collapse of the liner, both the inner layer and the outer layer are arranged to be compressed towards a symmetry axis (x) of the liner, thereby forming a projectile, and in a second state, the inner layer is arranged to form a penetration jet of the projectile and the outer layer is arranged to form a slug of the projectile, wherein the melting point of the outer layer is above 100° C., and the thickness of the outer layer ranges from 0.5 mm to 5 mm.

2. The liner according to claim 1, wherein the outer layer has a density below 1.7 g/cm3.

3. The liner according to claim 2, wherein the outer layer has a density below 1.4 g/cm3.

4. The liner according to claim 1, wherein the inner layer has a density below 10.3 g/cm3.

5. The liner according to claim 4, wherein the inner layer has a density below 10.1 g/cm3.

6. The liner according to claim 1, wherein the outer layer is a plastic material such as a thermoplastic polymer or a thermosetting polymer.

7. The liner according to claim 6, wherein the thermoplastic material is polytetrafluorethene (PTFE) or polyetheretherketone (PEEK).

8. The liner according to claim 6, wherein the thermosetting polymer is polyurethanes or epoxy.

9. The liner according to claim 1, wherein the inner layer has a speed of sound of above 3000 m/s.

10. The according to claim 9, wherein the inner layer has a speed of sound of above 3900 m/s.

11. The liner according to claim 1, wherein the inner layer comprises a metal such as copper, molybdenum or nickel or an alloy thereof.

12. The liner according to claim 1, wherein a thickness of the inner layer ranges from 0.2 to 0.8 mm.

13. The liner according to claim 12, wherein a thickness of the inner layer ranges from 0.4 to 0.6 mm.

14. A shaped charge comprising a liner according to claim 1.

15. A method of manufacturing a liner for a shaped charge according to claim 1, comprising the steps of pressing a plate of the inner layer into a desired shape and molding or curing the outer layer onto the pressed plate of the inner layer.

16. A method for detonation of a shaped charge comprising a liner according to claim 1, comprising the steps of:

detonating an explosive charge arranged in the shaped charge, wherein a detonation front travels in an expanding spherical shock wave towards the liner; and collapsing of the liner, wherein in a first state both the inner layer and the outer layer are compressed towards the symmetry axis (x) of the liner, thereby forming a projectile and in a second state the inner layer forms a penetration jet of the projectile and the outer layer forms a slug of the projectile.

* * * * *